US011355044B2

(12) United States Patent
Xi et al.

(10) Patent No.: US 11,355,044 B2
(45) Date of Patent: Jun. 7, 2022

(54) GOA CIRCUIT AND DISPLAY PANEL

(71) Applicant: SHENZHEN CHINA STAR OPTOELECTRONICS SEMICONDUCTOR DISPLAY TECHNOLOGY CO., LTD., Shenzhen (CN)

(72) Inventors: Suping Xi, Shenzhen (CN); Tianhong Wang, Shenzhen (CN)

( * ) Notice: Subject to any disclaimer, the term of this patent is extended or adjusted under 35 U.S.C. 154(b) by 215 days.

(21) Appl. No.: 16/759,333

(22) PCT Filed: Nov. 4, 2019

(86) PCT No.: PCT/CN2019/115320

§ 371 (c)(1),
(2) Date: Apr. 26, 2020

(87) PCT Pub. No.: WO2021/027091

PCT Pub. Date: Feb. 18, 2021

(65) Prior Publication Data

US 2021/0407357 A1 Dec. 30, 2021

(30) Foreign Application Priority Data

Aug. 13, 2019 (CN) ..... 201910742346.1

(51) Int. Cl.
*G09G 3/3266* (2016.01)
*G09G 3/20* (2006.01)

(52) U.S. Cl.
CPC ..... *G09G 3/20* (2013.01); *G09G 2310/0267* (2013.01); *G09G 2310/08* (2013.01)

(58) Field of Classification Search
CPC ..... G09G 3/20; G09G 2310/0267; G09G 2310/08
See application file for complete search history.

(56) References Cited

U.S. PATENT DOCUMENTS 9,472,150 B1 * 10/2016 Dai ..... H04N 13/344
9,548,036 B2 * 1/2017 Dai ..... G09G 3/3677
9,767,751 B2 * 9/2017 Dai ..... G09G 3/3677
9,934,749 B2 * 4/2018 Yu ..... G09G 3/20

FOREIGN PATENT DOCUMENTS

CN 107093399 A 8/2017
CN 108320717 A 7/2018
CN 109493783 A 3/2019
CN 109935191 A 6/2019
KR 20170038304 A 4/2017

OTHER PUBLICATIONS

PCT/CN2019/115320 International Search Report (English translation only) and Written Opinion (in Chinese with partial English translation). (Year: 2020).*

* cited by examiner

*Primary Examiner* — Julie Anne Watko

(57) ABSTRACT

A gate driver on array (GOA) circuit and a display panel are provided. A pull-down maintaining module of the GOA circuit includes an eleventh transistor and a twelfth transistor to remove a residual charge of a second node and a third node to enhance a stability of the GOA circuit.

20 Claims, 3 Drawing Sheets

GOA CIRCUIT AND DISPLAY PANEL

The present disclosure relates to display technologies, and more particularly, to a gate driver on array (GOA) circuit and a display panel.

BACKGROUND

A gate driver on array (GOA) technology integrates a gate drive circuit on an array substrate of a display panel, so that a gate drive integrated circuit can be omitted to reduce product cost in two aspects of material cost and production processes.

An existing GOA circuit needs to maintain a low level of a row scan signal for a period after outputting the row scan signal of a current stage GOA unit. However, because transistors work for a long time, electrical properties of the transistors are easily damaged to result in the GOA circuit not working properly.

SUMMARY

In view of the above, the present disclosure provides a gate driver on array (GOA) circuit and a display panel to solve a technical issue that transistors work for a long time to damage electrical properties of the transistors easily to result in the GOA circuit not working properly.

In order to achieve above-mentioned object of the present disclosure, one embodiment of the disclosure provides a GOA circuit, including a plurality of cascading GOA units, wherein each of the GOA units includes: a node control module, a transmission module, a pull-up module, a pull-down module, a pull-down maintaining module, and a bootstrap capacitor;

the node control module is configured to receive a scan signal and a transmission signal from a previous GOA unit, electrically connected to a first node, and configured to control an electrical level of the first node according to the scan signal and the transmission signal from the previous GOA unit;

the transmission module is configured to receive a first clock signal of a current GOA unit, electrically connected to the first node, and configured to output a transmission signal of the current GOA unit according to control of the electrical level of the first node;

the pull-up module is configured to receive the first clock signal of the current GOA unit, electrically connected to the first node, and configured to output a scan signal of the current GOA unit according to control of the electrical level of the first node;

the pull-down module is configured to receive a scan signal from a next GOA unit and a reference low level signal, electrically connected to the first node and the scan signal of the current GOA unit, and configured to pull down the electrical level of the first node and the scan signal of the current GOA unit to an electrical level of the reference low level signal according to control of the scan signal from the next GOA unit;

the pull-down maintaining module is configured to receive a second clock signal of the current GOA unit, the first clock signal of the current GOA unit, the transmission signal of the current GOA unit, and the reference low level signal, electrically connected to the first node, and configured to maintain the electrical level of the first node and to remove a residual charge of the pull-down maintaining module according to the first clock signal of the current GOA unit, the second clock signal of the current GOA unit, the transmission signal of the current GOA unit, and the reference low level signal;

a first end of the bootstrap capacitor is electrically connected to the first node, and a second end of the bootstrap capacitor is electrically connected to the scan signal of the current GOA unit;

the node control module includes a first transistor;

a gate of the first transistor is electrically connected a scan signal from the previous GOA unit, a source of the first transistor is electrically connected to the transmission signal from the previous GOA unit, and a drain of the first transistor is electrically connected to the first node;

the transmission module includes a second transistor;

a gate of the second transistor is electrically connected to the first node, a source of the second transistor is electrically connected to the first clock signal of the current GOA unit, and a drain of the second transistor is electrically connected to the transmission signal of the current GOA unit.

In one embodiment of the GOA circuit, the pull-up module includes a third transistor; and a gate of the third transistor is electrically connected to the first node, a source of the third transistor is electrically connected to the first clock signal of the current GOA unit, and a drain of the third transistor is electrically connected to the scan signal of the current GOA unit.

In one embodiment of the GOA circuit, the pull-down module includes a fourth transistor, and a fifth transistor; and a gate of the fourth transistor and a gate of the fifth transistor are all electrically connected to the scan signal from the next GOA unit, a source of the fourth transistor and a source of the fifth transistor are all electrically connected to the reference low level signal, a drain of the fourth transistor is electrically connected to the first node, and a drain of the fifth transistor is electrically connected to the scan signal of the current GOA unit.

In one embodiment of the GOA circuit, the pull-down maintaining module includes a sixth transistor, a seventh transistor, an eighth transistor, a ninth transistor, a tenth transistor, an eleventh transistor, and a twelfth transistor; and a gate of the sixth transistor, a source of the sixth transistor, a source of the seventh transistor, and a gate of the eleventh transistor are all electrically connected to the first clock signal of the current GOA unit, a drain of the sixth transistor, a gate of the seventh transistor, a drain of the ninety transistor, and a drain of the twelfth transistor are all electrically connected to the second node, a drain of the seventh transistor, a drain of the eighth transistor, a gate of the tenth transistor, and a drain of the eleventh transistor are all electrically connected to the third node, a gate of the eighth transistor and a gate of the ninety transistor are both electrically connected to the transmission signal of the current GOA unit, a source of the eighth transistor, a source of the ninety transistor, a source of the tenth transistor, a source of the eleventh transistor, and a source of the twelfth transistor are all electrically connected to the reference low level signal, a drain of the tenth transistor is electrically connected to the first node, and a gate of the twelfth transistor is electrically connected to the second clock signal of the current GOA unit.

In one embodiment of the GOA circuit, a phase of the first clock signal of the current GOA unit and a phase of the second clock signal of the current GOA unit are opposite.

In one embodiment of the GOA circuit, the first clock signal and the second clock signal of the current GOA unit are provided by an outer timer.

In one embodiment of the GOA circuit, the reference low level signal is provided by a direct current power.

Another embodiment of the disclosure provides a GOA circuit, including a plurality of cascading GOA units, wherein each of the GOA units includes: a node control module, a transmission module, a pull-up module, a pull-down module, a pull-down maintaining module, and a bootstrap capacitor;

the node control module is configured to receive a scan signal and a transmission signal from a previous GOA unit, electrically connected to a first node, and configured to control an electrical level of the first node according to the scan signal and the transmission signal from the previous GOA unit;

the transmission module is configured to receive a first clock signal of a current GOA unit, electrically connected to the first node, and configured to output a transmission signal of the current GOA unit according to control of the electrical level of the first node;

the pull-up module is configured to receive the first clock signal of the current GOA unit, electrically connected to the first node, and configured to output a scan signal of the current GOA unit according to control of the electrical level of the first node;

the pull-down module is configured to receive a scan signal from a next GOA unit and a reference low level signal, electrically connected to the first node and the scan signal of the current GOA unit, and configured to pull down the electrical level of the first node and the scan signal of the current GOA unit to an electrical level of the reference low level signal according to control of the scan signal from the next GOA unit;

the pull-down maintaining module is configured to receive a second clock signal of the current GOA unit, the first clock signal of the current GOA unit, the transmission signal of the current GOA unit, and the reference low level signal, electrically connected to the first node, and configured to maintain the electrical level of the first node and to remove a residual charge of the pull-down maintaining module according to the first clock signal of the current GOA unit, the second clock signal of the current GOA unit, the transmission signal of the current GOA unit, and the reference low level signal;

a first end of the bootstrap capacitor is electrically connected to the first node, and a second end of the bootstrap capacitor is electrically connected to the scan signal of the current GOA unit;

In one embodiment of the GOA circuit, the node control module includes a first transistor; and a gate of the first transistor is electrically connected a scan signal from the previous GOA unit, a source of the first transistor is electrically connected to the transmission signal from the previous GOA unit, and a drain of the first transistor is electrically connected to the first node;

In one embodiment of the GOA circuit, the transmission module includes a second transistor; and a gate of the second transistor is electrically connected to the first node, a source of the second transistor is electrically connected to the first clock signal of the current GOA unit, and a drain of the second transistor is electrically connected to the transmission signal of the current GOA unit.

In one embodiment of the GOA circuit, the pull-up module includes a third transistor; and a gate of the third transistor is electrically connected to the first node, a source of the third transistor is electrically connected to the first clock signal of the current GOA unit, and a drain of the third transistor is electrically connected to the scan signal of the current GOA unit.

In one embodiment of the GOA circuit, the pull-down module includes a fourth transistor, and a fifth transistor; and a gate of the fourth transistor and a gate of the fifth transistor are all electrically connected to the scan signal from the next GOA unit, a source of the fourth transistor and a source of the fifth transistor are all electrically connected to the reference low level signal, a drain of the fourth transistor is electrically connected to the first node, and a drain of the fifth transistor is electrically connected to the scan signal of the current GOA unit.

In one embodiment of the GOA circuit, the pull-down maintaining module includes a sixth transistor, a seventh transistor, an eighth transistor, a ninety transistor, a tenth transistor, an eleventh transistor, and a twelfth transistor; and a gate of the sixth transistor, a source of the sixth transistor, a source of the seventh transistor, and a gate of the eleventh transistor are all electrically connected to the first clock signal of the current GOA unit, a drain of the sixth transistor, a gate of the seventh transistor, a drain of the ninety transistor, and a drain of the twelfth transistor are all electrically connected to the second node, a drain of the seventh transistor, a drain of the eighth transistor, a gate of the tenth transistor, and a drain of the eleventh transistor are all electrically connected to the third node, a gate of the eighth transistor and a gate of the ninety transistor are both electrically connected to the transmission signal of the current GOA unit, a source of the eighth transistor, a source of the ninety transistor, a source of the tenth transistor, a source of the eleventh transistor, and a source of the twelfth transistor are all electrically connected to the reference low level signal, a drain of the tenth transistor is electrically connected to the first node, and a gate of the twelfth transistor is electrically connected to the second clock signal of the current GOA unit.

In one embodiment of the GOA circuit, a phase of the first clock signal of the current GOA unit and a phase of the second clock signal of the current GOA unit are opposite.

In one embodiment of the GOA circuit, the first clock signal and the second clock signal of the current GOA unit are provided by an outer timer.

In one embodiment of the GOA circuit, the reference low level signal is provided by a direct current power.

Another embodiment of the disclosure provides a display panel, including a gate driver on array (GOA) circuit, wherein the GOA circuit includes a plurality of cascading GOA units, and each of the GOA units includes: a node control module, a transmission module, a pull-up module, a pull-down module, a pull-down maintaining module, and a bootstrap capacitor;

the node control module is configured to receive a scan signal and a transmission signal from a previous GOA unit, electrically connected to a first node, and configured to control an electrical level of the first node according to the scan signal and the transmission signal from the previous GOA unit;

the transmission module is configured to receive a first clock signal of a current GOA unit, electrically connected to the first node, and configured to output a transmission signal of the current GOA unit according to control of the electrical level of the first node;

the pull-up module is configured to receive the first clock signal of the current GOA unit, electrically connected to the first node, and configured to output a scan signal of the current GOA unit according to control of the electrical level of the first node;

the pull-down module is configured to receive a scan signal from a next GOA unit and a reference low level signal, electrically connected to the first node and the scan signal of the current GOA unit, and configured to pull down the electrical level of the first node and the scan signal of the current GOA unit to an electrical level of the reference low level signal according to control of the scan signal from the next GOA unit;

the pull-down maintaining module is configured to receive a second clock signal of the current GOA unit, the first clock signal of the current GOA unit, the transmission signal of the current GOA unit, and the reference low level signal, electrically connected to the first node, and configured to maintain the electrical level of the first node and to remove a residual charge of the pull-down maintaining module according to the first clock signal of the current GOA unit, the second clock signal of the current GOA unit, the transmission signal of the current GOA unit, and the reference low level signal;

a first end of the bootstrap capacitor is electrically connected to the first node, and a second end of the bootstrap capacitor is electrically connected to the scan signal of the current GOA unit;

In one embodiment of the display panel, the node control module includes a first transistor; and a gate of the first transistor is electrically connected a scan signal from the previous GOA unit, a source of the first transistor is electrically connected to the transmission signal from the previous GOA unit, and a drain of the first transistor is electrically connected to the first node;

In one embodiment of the display panel, the transmission module includes a second transistor; and a gate of the second transistor is electrically connected to the first node, a source of the second transistor is electrically connected to the first clock signal of the current GOA unit, and a drain of the second transistor is electrically connected to the transmission signal of the current GOA unit.

In one embodiment of the display panel, the pull-up module includes a third transistor; and a gate of the third transistor is electrically connected to the first node, a source of the third transistor is electrically connected to the first clock signal of the current GOA unit, and a drain of the third transistor is electrically connected to the scan signal of the current GOA unit.

In comparison with prior art, the GOA circuit and the display panel provides the eleventh transistor and the twelfth transistor in the pull-down maintaining module to remove a residual charge of a second node and a third node by the eleventh transistor and the twelfth transistor to enhance a stability of the GOA circuit.

BRIEF DESCRIPTION OF DRAWINGS

In order to more clearly explain technical solutions in embodiments of the present application, following will briefly introduce drawings required in description of the embodiments. Obviously, the drawings in the following description are only some embodiments of the present application. For those skilled in the art, without paying any creative work, other drawings can also be obtained based on these drawings

DETAILED DESCRIPTION

Figure 1:
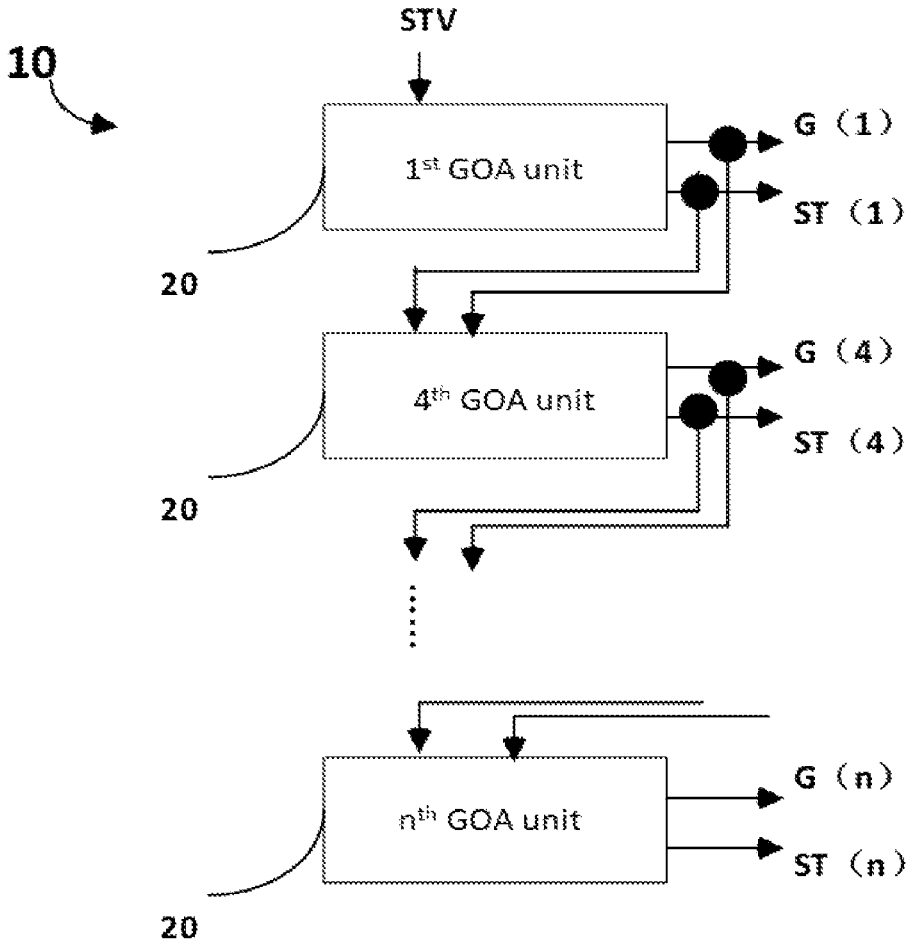
FIG. 1 is a schematic view of structure of a GOA circuit according to an embodiment of the present disclosure.

The following description of the embodiments is provided by reference to the drawings and illustrates the specific embodiments of the present disclosure. Directional terms mentioned in the present disclosure, such as "up," "down," "top," "bottom," "forward," "backward," "left," "right," "inside," "outside," "side," "peripheral," "central," "horizontal," "peripheral," "vertical," "longitudinal," "axial," "radial," "uppermost" or "lowermost," etc., are merely indicated the direction of the drawings. Therefore, the directional terms are used for illustrating and understanding of the application rather than limiting thereof.

Transistors used in all embodiments of the present application may be thin film transistors, field effect transistors or other devices with same characteristics. Since a source and a drain of the transistor used here are symmetrical, the source and the drain can be interchanged. In the embodiment of the present application, in order to distinguish the two electrodes of the transistor except a gate, one of the electrodes is called a source electrode, and the other electrode is called a drain electrode. According to a form in the drawing, the middle end of a switching transistor is a gate, a signal input end is a source, and an output end is a drain. In addition, the transistors used in the embodiments of the present application are all N-type transistors or P-type transistors, where the N-type transistor is turned on when the gate is at a high level, and is turned off when the gate is at a low level; the P-type transistor is turned on when the gate is at a low level and turned off when the gate is at a high level.

Referring to FIG. 1, FIG. 1 is a schematic view of structure of a gate driver on array (GOA) circuit according to an embodiment of the present disclosure. As shown in FIG. 1, one embodiment of the disclosure provides a GOA circuit 10, including a plurality of cascading GOA units 20. Each of the GOA units 20 is configured to output a scan signal and a transmission signal. When the GOA circuit 10 works, a first stage of the GOA unit 20 receives a starting signal STV, and then, starts a fourth stage of the GOA unit 20, a seventh stage of the GOA circuit 20, . . . , and a last stage of the GOA unit 20 is a cascade sequence.

Figure 2:
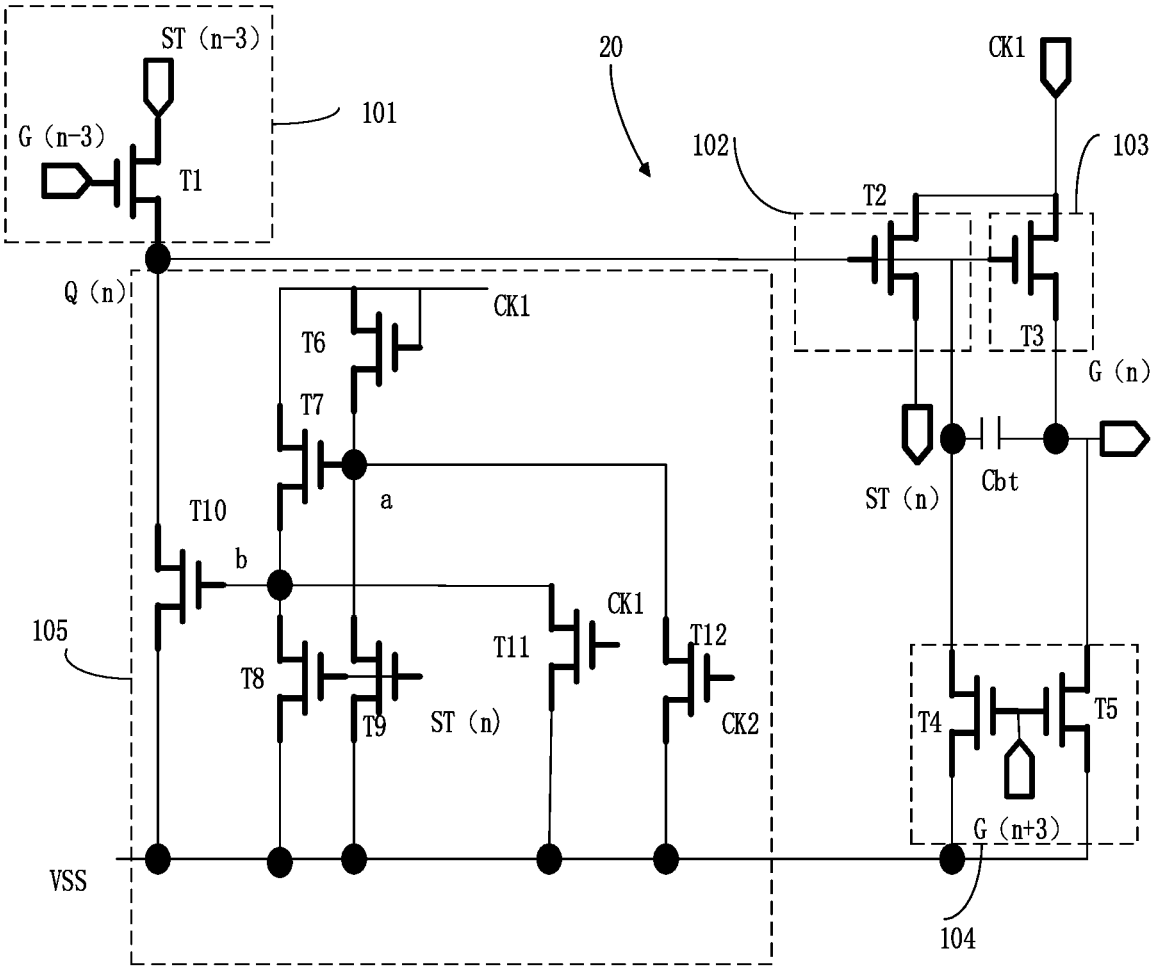
FIG. 2 is a schematic view of a circuit of a GOA unit of a GOA circuit according to an embodiment of the present disclosure.

Referring to FIG. 2, FIG. 2 is a schematic view of a circuit of a GOA unit of a GOA circuit according to an embodiment of the present disclosure. As shown in the FIG. 2, the GOA units 20 includes: a node control module 101, a transmission module 102, a pull-up module 103, a pull-down module 104, a pull-down maintaining module 105, and a bootstrap capacitor Cbt.

The node control module 101 is configured to receive a scan signal G(n−3) and a transmission signal ST(n−3) from a previous GOA unit, electrically connected to a first node Q(n), and configured to control an electrical level of the first node Q(n) according to the scan signal G(n−3) and the transmission signal ST(n−3) from the previous GOA unit.

The transmission module 102 is configured to receive a first clock signal CK1 of a current GOA unit, electrically connected to the first node Q(n), and configured to output a transmission signal ST(n) of the current GOA unit according to control of the electrical level of the first node Q(n).

The pull-up module 103 is configured to receive the first clock signal CK1 of the current GOA unit, electrically connected to the first node Q(n), and configured to output a scan signal G(n) of the current GOA unit according to control of the electrical level of the first node Q(n).

The pull-down module 104 is configured to receive a scan signal G((n−3) from a next GOA unit and a reference low level signal VSS, electrically connected to the first node Q(n) and the scan signal G(n) of the current GOA unit, and configured to pull down the electrical level of the first node Q(n) and the scan signal G(n) of the current GOA unit to an electrical level of the reference low level signal VSS according to control of the scan signal G(n+3) from the next GOA unit;

The pull-down maintaining module 105 is configured to receive a second clock signal CK2 of the current GOA unit, the first clock signal CK1 of the current GOA unit, the transmission signal ST(n) of the current GOA unit, and the reference low level signal VSS, electrically connected to the first node Q(n), and configured to maintain the electrical level of the first node Q(n) and to remove a residual charge of the pull-down maintaining module 105 according to the first clock signal CK1 of the current GOA unit, the second clock signal CK2 of the current GOA unit, the transmission signal ST(n) of the current GOA unit, and the reference low level signal VSS.

A first end of the bootstrap capacitor Cbt is electrically connected to the first node Q(n), and a second end of the bootstrap capacitor Cbt is electrically connected to the scan signal G(n) of the current GOA unit.

In one embodiment of the disclosure, the node control module 101 includes a first transistor T1. A gate of the first transistor T1 is electrically connected a scan signal G(n−3) from the previous GOA unit, a source of the first transistor T1 is electrically connected to the transmission signal ST(n−3) from the previous GOA unit, and a drain of the first transistor T1 is electrically connected to the first node Q(n).

In one embodiment of disclosure, the transmission module 102 includes a second transistor T2. A gate of the second transistor T2 is electrically connected to the first node Q(n), a source of the second transistor T2 is electrically connected to the first clock signal CK1 of the current GOA unit, and a drain of the second transistor T2 is electrically connected to the transmission signal ST(n) of the current GOA unit.

In one embodiment of the GOA circuit, the pull-up module 103 includes a third transistor T3. A gate of the third transistor T3 is electrically connected to the first node Q(n), a source of the third transistor T3 is electrically connected to the first clock signal CK1 of the current GOA unit, and a drain of the third transistor T3 is electrically connected to the scan signal G(n) of the current GOA unit.

In one embodiment of the GOA circuit, the pull-down module 104 includes a fourth transistor T4, and a fifth transistor T5. A gate of the fourth transistor T4 and a gate of the fifth transistor T5 are all electrically connected to the scan signal G(n+3) from the next GOA unit, a source of the fourth transistor T4 and a source of the fifth transistor T5 are all electrically connected to the reference low level signal VSS, a drain of the fourth transistor T4 is electrically connected to the first node Q(n), and a drain of the fifth transistor T5 is electrically connected to the scan signal G(n) of the current GOA unit.

In one embodiment of the GOA circuit, the pull-down maintaining module 105 includes a sixth transistor T6, a seventh transistor T7, an eighth transistor T8, a ninety transistor T9, a tenth transistor T10, an eleventh transistor T11, and a twelfth transistor T12.

A gate of the sixth transistor T6, a source of the sixth transistor T6, a source of the seventh transistor T7, and a gate of the eleventh transistor T11 are all electrically connected to the first clock signal CK1 of the current GOA unit. A drain of the sixth transistor T6, a gate of the seventh transistor T7, a drain of the ninety transistor T9, and a drain of the twelfth transistor T12 are all electrically connected to the second node "a". A drain of the seventh transistor T7, a drain of the eighth transistor T8, a gate of the tenth transistor T10, and a drain of the eleventh transistor T11 are all electrically connected to the third node "b". A gate of the eighth transistor T8 and a gate of the ninety transistor T9 are both electrically connected to the transmission signal ST(n) of the current GOA unit. A source of the eighth transistor T8, a source of the ninety transistor T9, a source of the tenth transistor T10, a source of the eleventh transistor T11, and a source of the twelfth transistor T12 are all electrically connected to the reference low level signal VSS. A drain of the tenth transistor T10 is electrically connected to the first node Q(n). A gate of the twelfth transistor T12 is electrically connected to the second clock signal CK2 of the current GOA unit.

In one embodiment of the GOA circuit of the disclosure, a phase of the first clock signal CK1 of the current GOA unit and a phase of the second clock signal CK2 of the current GOA unit are opposite. The first clock signal CK1 and the second clock signal CK2 of the current GOA unit are provided by an outer timer. The reference low level signal VSS is provided by a direct current power.

Figure 3:
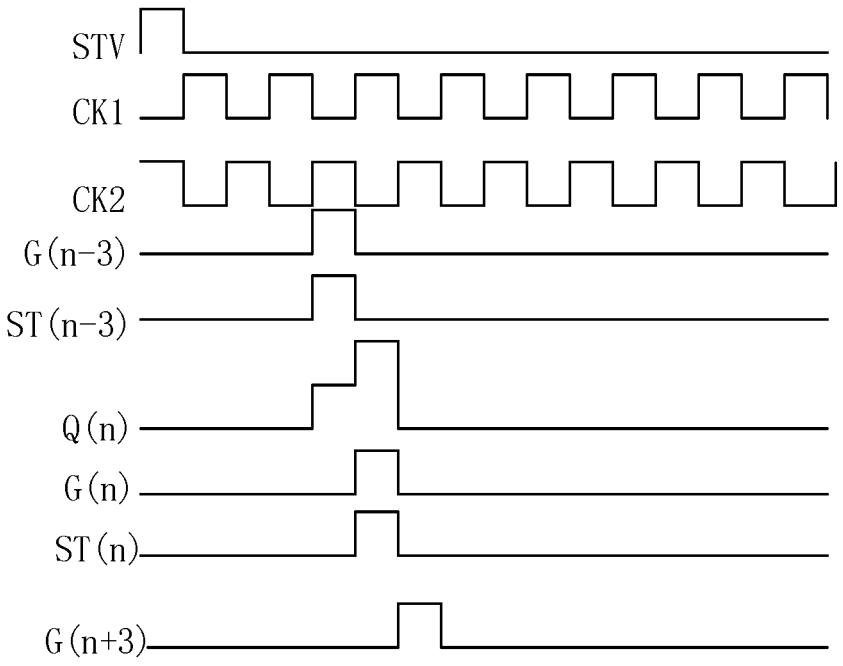
FIG. 3 is a schematic view of a signal time sequence of a GOA unit of a GOA circuit according to an embodiment of the present disclosure.

In detail, referring to FIG. 2, and FIG. 3, FIG. 3 is a schematic view of a signal time sequence of a GOA unit of a GOA circuit according to an embodiment of the present disclosure.

When the transmission signal ST(n−3) from the previous GOA unit is at a high level, and the scan signal G(n−3) from the previous GOA unit is at a high level, the first transistor T1 is turned on, and the transmission signal ST(n−3) from the previous GOA unit charges the bootstrap capacitor Cbt to raise a electrical level of the first node Q(n) to a higher level.

After that, the scan signal G(n−3) of the previous GOA unit is transferred to a low level. The first transistor T1 is turned off. The electrical level of the first node Q(n) is maintained a higher level by the bootstrap capacitor Cbt. Meanwhile, an electrical level of the first clock signal CK1 of the current GOA unit is transferred to a high level. The first clock signal CK1 of the current GOA unit charges the bootstrap capacitor Cbt through the second transistor T2 continuously to raise the electrical level of the first node Q(n) to a further higher level. The scan signal G(n) and the transmission signal ST(n) of the current GOA unit are both transferred to a high level.

Then, when the scan signal G(n+3) from the next GOA unit is transferred to a high level, the fourth transistor T4 and the fifth transistor T5 are turned on, and the reference low level signal VSS pulls down levels of first node Q(n) and the scan signal G(n) of the current GOA unit.

Finally, the eighth transistor T8 and the ninety transistor T9 are turned off because the transmission signal ST(n) transfers to a low level. Meanwhile, the first clock signal CK1 of the current GOA unit is at a high level to turned on the sixth transistor T6 and the seventh transistor T7. The first clock signal CK1 of the current GOA unit transmits to the third node "b" to turned on the tenth transistor T10. The reference low level signal VSS maintains the electrical level of the first node Q(n) to a level of the reference low level signal VSS to maintain a level of the scan signal G(n) of the current GOA unit.

In detail, the embodiment of the disclosure provides the eleventh transistor T11 and the twelfth transistor T12 in the pull-down maintaining module 105 to remove a residual charge of a second node "a" and a third node "b" by the eleventh transistor T11 and the twelfth transistor T12 to enhance a stability of the GOA circuit.

There is only one period in a frame of a display image for the clock signal of the current GOA unit to be at the high level. However, there are many periods for the first clock signal CK1 of the current GOA unit to be at the high level. If there has no eleventh transistor T11 and twelfth transistor T12 in the pull-down maintaining module 105, the pull-down maintaining module 105 will go into three circumstances as following: 1) when the first clock signal CK1 and the transmission signal ST(n) of the current GOA unit are both at the high level, the sixth transistor T6, the seventh transistor T7, the eighth transistor T8, and the ninety transistor T9 are all turned on, and the third node "b" outputs a high level; 2) when the transmission signal ST(n) of the current GOA unit is at a low level, if the first clock signal CK1 of the current GOA unit is at a high level, the eighth transistor T8 and the ninety transistor T9 are both turned off, and gates and sources of the sixth transistor T6 and the seventh transistor T7 are both at a high level. Charges at the third node "b" has no way to release because the eighth transistor T8 and the ninety transistor T9 are both turned off. A threshold voltage shift of the seventh transistor T7 will be accelerated. 3) When the transmission signal ST(n) of the current GOA unit is still at the low level, if the first clock signal CK1 of the current GOA unit is also at a low level, the eighth transistor T8 and the ninety transistor T9 are both turned off. A low level of the second node "a" is not lower enough because the source and the drain of the sixth transistor T6 are connected. The seventh transistor T7 will be turned on slightly. A low level of the first clock signal CK1 of the current GOA unit will pass the seventh transistor T7 to pull down an electrical level of the third node "b". That is, the electrical level of the third node "b" cannot reach a higher level. It will affect an on state of the tenth transistor T10, and the electrical level of the first node Q(n), then affect output of the scan signal G(n) of the current GOA unit. The second node "a" has no electrical path at this moment and the electrical charge of the second node "a" will be remained. A threshold voltage shift of the sixth transistor T6 and the threshold voltage shift of the seventh transistor T7 will be accelerated.

Based on the above analysis, an embodiment of the disclosure provides a eleventh transistor T11 at the third node "b" and provide a twelfth transistor T12 at the second node "a". 1) When the first clock signal CK1 and the transmission signal ST(n) of the current GOA unit are both at the high level, the second clock signal CK2 of the current GOA unit is at a low level, the twelfth transistor T12 is turned off, the second node "a" is maintained a high level, and the gate of the eleventh transistor T11 is the first clock signal CK1 of the current GOA circuit. The eleventh transistor T11 is turned on, and the third node "b" is pulled down to the electrical level of the reference low level signal VSS by the eleventh transistor T11. 2) When the transmission signal ST(n) of the current GOA unit is at the low level, if the first clock signal CK1 of the current GOA unit is at a high level, the second clock signal CK2 of the current GOA unit is at a low level. The eighth transistor T8, the ninety transistor T9, and the twelfth transistor T12 are all turned off. The sixth transistor T6, the seventh transistor T7, and the eleventh transistor T11 are all turned on. The seventh transistor T7 and the eleventh transistor T11 are arranged to make the second node "a" output high level. Conduction of the seventh transistor T7 and the eleventh transistor T11 can discharge the third node "b" to avoid from a lot of residual electrical charge, and reduce damage on electrical characters of a transistor due to a lot of residual electrical charge at the third node "b". 3) When the transmission signal ST(n) of the current GOA unit is still at the low level, if the first clock signal CK1 of the current GOA unit is also at a low level, the second clock signal CK2 of the current GOA unit is at a high level. The eighth transistor T8, the ninety transistor T9, and the eleventh transistor T11 are all turned off. The twelfth transistor T12 is turned on. When the first clock signal CK1 of the current GOA unit transfers to a low level, a low level of the second node "a" passing through the sixth transistor T6 is not lower enough because the source and the drain of the sixth transistor T6 are connected. The seventh transistor T7 will be turned on slightly. But the twelfth transistor T12 is turned on to pull the electrical level of the second node "a" to a very low level. That is, the electrical level of the second node "a" is lower enough to lock the seventh transistor T7 tightly. Then a high level of the third node "b" can keep at a very high level to turn on the tenth transistor T10 well. The first node Q(n) can maintain a normal waveform. On the other hand, because the twelfth transistor T12 is at an on state, residual charge of the second node "a" can pass through the twelfth transistor T12 to the reference low level signal VSS to avoid from a lot of residual electrical charge, and reduce damage on electrical characters of a transistor due to a lot of residual electrical charge at the second node "a".

Figure 4:
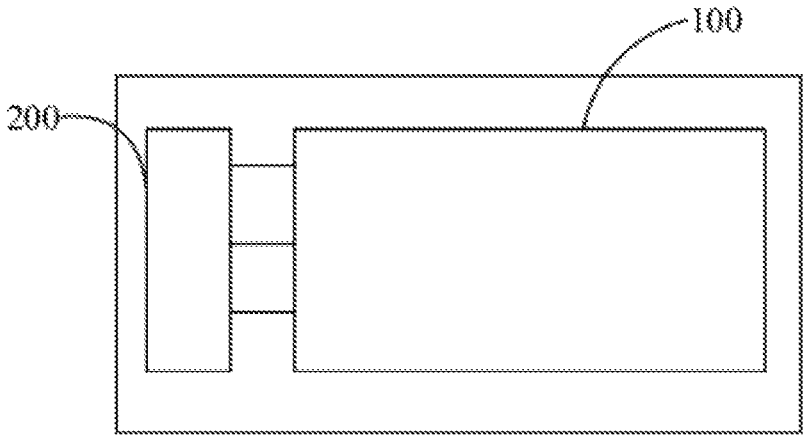
FIG. 4 is a schematic view of a structure of a display panel according to a second embodiment of the present disclosure.

Referring to FIG. 4, FIG. 4 is a schematic view of a structure of a display panel according to a second embodiment of the present disclosure. As shown in FIG. 4, the display panel includes a display region 100 and a GOA circuit 200 integrated on an edge of the display region 100. Structures and principle of the GOA circuit 200 and the GOA circuit 10 are similar, here won't repeat.

The present disclosure has been described by the above embodiments, but the embodiments are merely examples for implementing the present disclosure. It must be noted that the embodiments do not limit the scope of the invention. In contrast, modifications and equivalent arrangements are intended to be included within the scope of the invention.

What is claimed is:

1. A gate driver on array (GOA) circuit, comprising a plurality of cascading GOA units, wherein each of the GOA units comprises: a node control module, a transmission module, a pull-up module, a pull-down module, a pull-down maintaining module, and a bootstrap capacitor;

the node control module is configured to receive a scan signal and a transmission signal from a previous GOA unit, electrically connected to a first node, and configured to control an electrical level of the first node according to the scan signal and the transmission signal from the previous GOA unit;

the transmission module is configured to receive a first clock signal of a current GOA unit, electrically connected to the first node, and configured to output a transmission signal of the current GOA unit according to control of the electrical level of the first node;

the pull-up module is configured to receive the first clock signal of the current GOA unit, electrically connected to the first node, and configured to output a scan signal of the current GOA unit according to control of the electrical level of the first node;

the pull-down module is configured to receive a scan signal from a next GOA unit and a reference low level signal, electrically connected to the first node and the scan signal of the current GOA unit, and configured to pull down the electrical level of the first node and the scan signal of the current GOA unit to an electrical level of the reference low level signal according to control of the scan signal from the next GOA unit;

the pull-down maintaining module is configured to receive a second clock signal of the current GOA unit, the first clock signal of the current GOA unit, the transmission signal of the current GOA unit, and the reference low level signal, electrically connected to the first node, and configured to maintain the electrical level of the first node and to remove a residual charge of the pull-down maintaining module according to the first clock signal of the current GOA unit, the second clock signal of the current GOA unit, the transmission signal of the current GOA unit, and the reference low level signal;

a first end of the bootstrap capacitor is electrically connected to the first node, and a second end of the bootstrap capacitor is electrically connected to the scan signal of the current GOA unit;

the node control module comprises a first transistor;

a gate of the first transistor is electrically connected a scan signal from the previous GOA unit, a source of the first transistor is electrically connected to the transmission signal from the previous GOA unit, and a drain of the first transistor is electrically connected to the first node;

the transmission module comprises a second transistor;

a gate of the second transistor is electrically connected to the first node, a source of the second transistor is electrically connected to the first clock signal of the current GOA unit, and a drain of the second transistor is electrically connected to the transmission signal of the current GOA unit.

2. The GOA circuit according to claim 1, wherein the pull-up module comprises a third transistor; and a gate of the third transistor is electrically connected to the first node, a source of the third transistor is electrically connected to the first clock signal of the current GOA unit, and a drain of the third transistor is electrically connected to the scan signal of the current GOA unit.

3. The GOA circuit according to claim 1, wherein the pull-down module comprises a fourth transistor, and a fifth transistor; and a gate of the fourth transistor and a gate of the fifth transistor are all electrically connected to the scan signal from the next GOA unit, a source of the fourth transistor and a source of the fifth transistor are all electrically connected to the reference low level signal, a drain of the fourth transistor is electrically connected to the first node, and a drain of the fifth transistor is electrically connected to the scan signal of the current GOA unit.

4. The GOA circuit according to claim 1, wherein the pull-down maintaining module comprises a sixth transistor, a seventh transistor, an eighth transistor, a ninth transistor, a tenth transistor, an eleventh transistor, and a twelfth transistor; and a gate of the sixth transistor, a source of the sixth transistor, a source of the seventh transistor, and a gate of the eleventh transistor are all electrically connected to the first clock signal of the current GOA unit, a drain of the sixth transistor, a gate of the seventh transistor, a drain of the ninth transistor, and a drain of the twelfth transistor are all electrically connected to the second node, a drain of the seventh transistor, a drain of the eighth transistor, a gate of the tenth transistor, and a drain of the eleventh transistor are all electrically connected to the third node, a gate of the eighth transistor and a gate of the ninth transistor are both electrically connected to the transmission signal of the current GOA unit, a source of the eighth transistor, a source of the ninth transistor, a source of the tenth transistor, a source of the eleventh transistor, and a source of the twelfth transistor are all electrically connected to the reference low level signal, a drain of the tenth transistor is electrically connected to the first node, and a gate of the twelfth transistor is electrically connected to the second clock signal of the current GOA unit.

5. The GOA circuit according to claim 1, wherein a phase of the first clock signal of the current GOA unit and a phase of the second clock signal of the current GOA unit are opposite.

6. The GOA circuit according to claim 1, wherein the first clock signal and the second clock signal of the current GOA unit are provided by an outer timer.

7. The GOA circuit according to claim 1, wherein the reference low level signal is provided by a direct current power.

8. A gate driver on array (GOA) circuit, comprising a plurality of cascading GOA units, wherein each of the GOA units comprises: a node control module, a transmission module, a pull-up module, a pull-down module, a pull-down maintaining module, and a bootstrap capacitor;

the node control module is configured to receive a scan signal and a transmission signal from a previous GOA unit, electrically connected to a first node, and configured to control an electrical level of the first node according to the scan signal and the transmission signal from the previous GOA unit;

the transmission module is configured to receive a first clock signal of a current GOA unit, electrically connected to the first node, and configured to output a transmission signal of the current GOA unit according to control of the electrical level of the first node;

the pull-up module is configured to receive the first clock signal of the current GOA unit, electrically connected to the first node, and configured to output a scan signal of the current GOA unit according to control of the electrical level of the first node;

the pull-down module is configured to receive a scan signal from a next GOA unit and a reference low level signal, electrically connected to the first node and the scan signal of the current GOA unit, and configured to pull down the electrical level of the first node and the scan signal of the current GOA unit to an electrical level of the reference low level signal according to control of the scan signal from the next GOA unit;

the pull-down maintaining module is configured to receive a second clock signal of the current GOA unit, the first clock signal of the current GOA unit, the transmission signal of the current GOA unit, and the reference low level signal, electrically connected to the first node, and configured to maintain the electrical level of the first node and to remove a residual charge of the pull-down maintaining module according to the first clock signal of the current GOA unit, the second clock signal of the current GOA unit, the transmission signal of the current GOA unit, and the reference low level signal;

a first end of the bootstrap capacitor is electrically connected to the first node, and a second end of the bootstrap capacitor is electrically connected to the scan signal of the current GOA unit.

9. The GOA circuit according to claim 8, wherein the node control module comprises a first transistor; and a gate of the first transistor is electrically connected a scan signal from the previous GOA unit, a source of the first transistor is electrically connected to the transmission signal from the previous GOA unit, and a drain of the first transistor is electrically connected to the first node.

10. The GOA circuit according to claim 8, wherein the transmission module comprises a second transistor; and a gate of the second transistor is electrically connected to the first node, a source of the second transistor is electrically connected to the first clock signal of the current GOA unit, and a drain of the second transistor is electrically connected to the transmission signal of the current GOA unit.

11. The GOA circuit according to claim 8, wherein the pull-up module comprises a third transistor; and a gate of the third transistor is electrically connected to the first node, a source of the third transistor is electrically connected to the first clock signal of the current GOA unit, and a drain of the third transistor is electrically connected to the scan signal of the current GOA unit.

12. The GOA circuit according to claim 8, wherein the pull-down module comprises a fourth transistor, and a fifth transistor; and a gate of the fourth transistor and a gate of the fifth transistor are all electrically connected to the scan signal from the next GOA unit, a source of the fourth transistor and a source of the fifth transistor are all electrically connected to the reference low level signal, a drain of the fourth transistor is electrically connected to the first node, and a drain of the fifth transistor is electrically connected to the scan signal of the current GOA unit.

13. The GOA circuit according to claim 8, wherein the pull-down maintaining module comprises a sixth transistor, a seventh transistor, an eighth transistor, a ninth transistor, a tenth transistor, an eleventh transistor, and a twelfth transistor; and a gate of the sixth transistor, a source of the sixth transistor, a source of the seventh transistor, and a gate of the eleventh transistor are all electrically connected to the first clock signal of the current GOA unit, a drain of the sixth transistor, a gate of the seventh transistor, a drain of the ninth transistor, and a drain of the twelfth transistor are all electrically connected to the second node, a drain of the seventh transistor, a drain of the eighth transistor, a gate of the tenth transistor, and a drain of the eleventh transistor are all electrically connected to the third node, a gate of the eighth transistor and a gate of the ninth transistor are both electrically connected to the transmission signal of the current GOA unit, a source of the eighth transistor, a source of the ninth transistor, a source of the tenth transistor, a source of the eleventh transistor, and a source of the twelfth transistor are all electrically connected to the reference low level signal, a drain of the tenth transistor is electrically connected to the first node, and a gate of the twelfth transistor is electrically connected to the second clock signal of the current GOA unit.

14. The GOA circuit according to claim 8, wherein a phase of the first clock signal of the current GOA unit and a phase of the second clock signal of the current GOA unit are opposite.

15. The GOA circuit according to claim 8, wherein the first clock signal and the second clock signal of the current GOA unit are provided by an outer timer.

16. The GOA circuit according to claim 8, wherein the reference low level signal is provided by a direct current power.

17. A display panel, comprising a gate driver on array (GOA) circuit, wherein the GOA circuit comprises a plurality of cascading GOA units, and each of the GOA units comprises: a node control module, a transmission module, a pull-up module, a pull-down module, a pull-down maintaining module, and a bootstrap capacitor;

the node control module is configured to receive a scan signal and a transmission signal from a previous GOA unit, electrically connected to a first node, and configured to control an electrical level of the first node according to the scan signal and the transmission signal from the previous GOA unit;

the transmission module is configured to receive a first clock signal of a current GOA unit, electrically connected to the first node, and configured to output a transmission signal of the current GOA unit according to control of the electrical level of the first node;

the pull-up module is configured to receive the first clock signal of the current GOA unit, electrically connected to the first node, and configured to output a scan signal of the current GOA unit according to control of the electrical level of the first node;

the pull-down module is configured to receive a scan signal from a next GOA unit and a reference low level signal, electrically connected to the first node and the scan signal of the current GOA unit, and configured to pull down the electrical level of the first node and the scan signal of the current GOA unit to an electrical level of the reference low level signal according to control of the scan signal from the next GOA unit;

the pull-down maintaining module is configured to receive a second clock signal of the current GOA unit, the first clock signal of the current GOA unit, the transmission signal of the current GOA unit, and the reference low level signal, electrically connected to the first node, and configured to maintain the electrical level of the first node and to remove a residual charge of the pull-down maintaining module according to the first clock signal of the current GOA unit, the second clock signal of the current GOA unit, the transmission signal of the current GOA unit, and the reference low level signal;

a first end of the bootstrap capacitor is electrically connected to the first node, and a second end of the bootstrap capacitor is electrically connected to the scan signal of the current GOA unit.

18. The display panel according to claim 17, wherein the node control module comprises a first transistor; and a gate of the first transistor is electrically connected a scan signal from the previous GOA unit, a source of the first transistor is electrically connected to the transmission signal from the previous GOA unit, and a drain of the first transistor is electrically connected to the first node.

19. The display panel according to claim 17, wherein the transmission module comprises a second transistor; and a gate of the second transistor is electrically connected to the first node, a source of the second transistor is electrically connected to the first clock signal of the current GOA unit, and a drain of the second transistor is electrically connected to the transmission signal of the current GOA unit.

20. The display panel according to claim 17, wherein the pull-up module comprises a third transistor; and a gate of the third transistor is electrically connected to the first node, a source of the third transistor is electrically connected to the first clock signal of the current GOA unit, and a drain of the third transistor is electrically connected to the scan signal of the current GOA unit.

* * * * *